US005295315A

United States Patent [19]

Osawa et al.

[11] Patent Number: 5,295,315

[45] Date of Patent: Mar. 22, 1994

[54] SHOE FASTENING DEVICE AND PLATE-SHAPED MEMBER THEREOF

[75] Inventors: Hajime Osawa, Nishinomiya; Yasuhiro Komori, Hiratsuka, both of Japan

[73] Assignee: Asics Corporation, Hyogo, Japan

[21] Appl. No.: 576,192

[22] Filed: Aug. 30, 1990

Related U.S. Application Data

[63] Continuation of Ser. No. 305,757, Feb. 3, 1989, abandoned.

[30] Foreign Application Priority Data

Feb. 23, 1988 [JP] Japan ..... 63-23358[U]
Nov. 10, 1988 [JP] Japan ..... 63-284754

[51] Int. Cl.[5] ..... A43C 7/06; A43C 9/00

[52] U.S. Cl. ..... 36/50.1; 36/51; 24/712

[58] Field of Search ..... 36/50, 51, 50.1; 24/117 R, 140, 143 A, 143 B, 144, 148, 712, 712.1, 713.1, 713.9, 300, 453, 573.1, 713

[56] References Cited

U.S. PATENT DOCUMENTS

| | | | |
|---|---|---|---|
| 451,420 | 4/1891 | La Dow | 24/144 |
| 1,211,544 | 1/1917 | Cheney | 24/144 |
| 1,247,435 | 11/1917 | McHannan | 36/51 |
| 1,296,529 | 3/1919 | Koester | 36/50 |
| 1,527,111 | 2/1925 | Bauman . | |
| 1,595,630 | 8/1926 | Stockton | 36/51 |
| 1,600,851 | 7/1926 | Sego | 36/50 |
| 1,898,225 | 2/1933 | Szabo | 24/140 |
| 1,966,135 | 7/1934 | Reh | 36/51 |
| 1,989,418 | 1/1935 | Hertzberg | 36/2 R |
| 2,289,225 | 7/1942 | Tonai | 24/140 |
| 2,662,308 | 12/1953 | Loewengart | 36/50 |
| 2,824,351 | 2/1958 | Webb | 36/50 |
| 3,550,218 | 12/1970 | Worrner | 36/50.1 |
| 4,210,983 | 7/1980 | Green | 24/143 A |
| 4,553,342 | 11/1985 | Derderian et al. | 36/50.1 |
| 4,633,548 | 1/1987 | Siskind et al. | 24/145 |
| 4,733,439 | 3/1988 | Gentry | 36/50 |
| 4,777,705 | 10/1988 | Ingram | 24/143 A |
| 4,790,048 | 12/1988 | Arnt | 24/140 |

FOREIGN PATENT DOCUMENTS

| | | | |
|---|---|---|---|
| 10398 | of 0000 | Australia . | |
| 29147/77 | of 0000 | Australia . | |
| 275115 | of 1964 | Australia . | |
| 39104 | of 1970 | Australia . | |
| 1991919 | 6/1968 | Fed. Rep. of Germany . | |
| 1183493 | of 1959 | France . | |
| 0095224 | 6/1922 | Switzerland | 36/50.1 |
| 28343 | of 1904 | United Kingdom | 36/50 |

*Primary Examiner*—Steven N. Meyers
*Attorney, Agent, or Firm*—Nixon & Vanderhye

[57] ABSTRACT

A shoe fastening device is arranged such that a protruding member disposed integrally on one of an upper cover and a band member is inserted into a receiving portion provided on the other of the upper cover and the band member to connect the band member and the upper cover, thereby fastening the upper cover through the band member. The shoe fastening device allows an optimum fastening condition to be simply obtained for the wearer with quickness.

11 Claims, 7 Drawing Sheets

SHOE FASTENING DEVICE AND PLATE-SHAPED MEMBER THEREOF

This is a continuation of application Ser. No. 07/305,757, filed Feb. 3, 1989, now abandoned.

BACKGROUND OF THE INVENTION

The present invention relates to a shoe fastening device and a plate-shaped member thereof.

As conventional means of fastening an upper cover of a shoe, there are one in which an opening portion formed in the upper cover is fastened with a lace-like member and another in which the opening portion is fastened with a band-shaped member using a plate-shaped engageable fastener such as a velvet fastener.

However, in the conventional fastening means, if, for instance, the lace-like member is used, there is a drawback in that it is difficult to adjust the fastening force applied to the upper cover of the shoe. In other words, the fastening means using the lace-like member has a drawback in that, since an elongated lace-like member is used, it is difficult for the fastening force to be transmitted to a front portion of the opening portion which is formed in the upper cover, located closer to the toes, and therefore remote from the position at which the lace-like is tied, with the result that the range in which the fastening force can be adjusted is restricted to a region which is close to the position at which the lace-like member is tied. Accordingly, if an attempt is made to fasten, for example, the front portion of the opening portion which is located close to the toes, it is necessary to effect fastening sequentially from the front portion located close to the toes toward the tying position of the lace-like member. On the other hand, if an attempt is made to loosen the lace-like member which has been tightened, it is necessary to loosen it sequentially from the tying position of the lace-like member toward the front portion close to the toes. Hence, it is very troublesome to adjust the fastening force applied to the upper cover.

On the other hand, in the case of the conventional fastening means using a band-shaped member which makes use of a plate-shaped engageable fastener such as a velvet fastener, although the adjustment of the fastening force applied to the upper cover is facilitated, there is the drawback that a joining force of the fastener is lost at an early stage since foreign substances are liable to adhere to the engaging members of the engageable fastener.

SUMMARY OF THE INVENTION

Accordingly, an object of the present invention is to provide a shoe fastening device which facilitates adjustment of a fastening force applied to the upper cover of a shoe and is capable of maintaining an optimum fastening force for the upper cover of the shoe for a long period of time, thereby overcoming the above-described drawbacks of the conventional art.

This end, in accordance with the present invention, is attained by a shoe fastening device comprising: a band member for fastening an upper cover of a shoe; and connecting means disposed between the upper cover and the band member so as to connect the band member to the upper cover, the connecting means being provided with a receiving portion disposed on one of the upper cover and the band member and with a protruding member disposed integrally on the other of the upper cover and the band member, and adapted to be insertable into the receiving portion.

The shoe fastening device in accordance with the present invention is arranged such that the protruding member disposed integrally on one of the upper cover and the band member is inserted into the receiving portion disposed on the other of the upper cover and the band member to connect the band member and the upper cover, thereby fastening the upper cover through the band member.

The above object, features and advantages of the present invention will become more apparent from the following detailed description of the present invention when read in conjunction with the accompanying drawings.

DETAILED DESCRIPTION OF THE PREFERRED EMBODIMENTS

Referring now to the accompanying drawings, a description will be given of a preferred embodiment of a shoe fastening device in accordance with the present invention.

Figure 1:
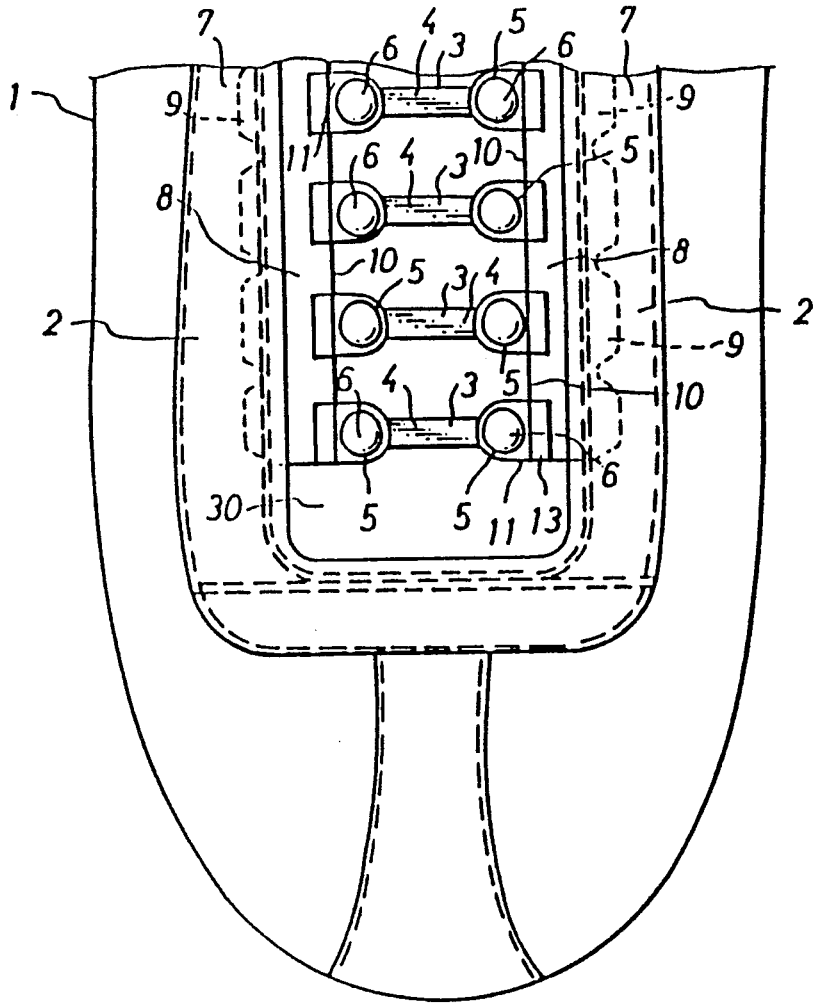
FIG. 1 is a view illustrating a state in which a shoe fastening device of the present invention is mounted on a shoe.

As shown in FIG. 1, the shoe fastening device in accordance with this embodiment comprises a plurality of band members 4 for fastening an upper cover 2 of a shoe 1, and connecting means disposed between the upper cover 2 and each of the band members 4 so as to connect the band members 4 to the upper cover 2, respectively. The connecting means includes a through hole 5 as a receiving portion which is disposed on the upper cover 2, and a protruding member 6 which is inserted in this through hole 5 and is disposed integrally with the band member 4.

Figure 2:
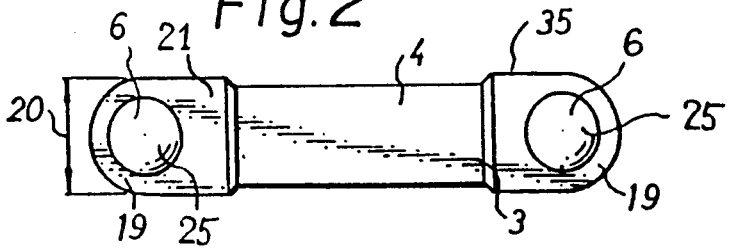
FIG. 2 is a top plan view of a band member of the shoe fastening device of the present invention.
Figure 3:
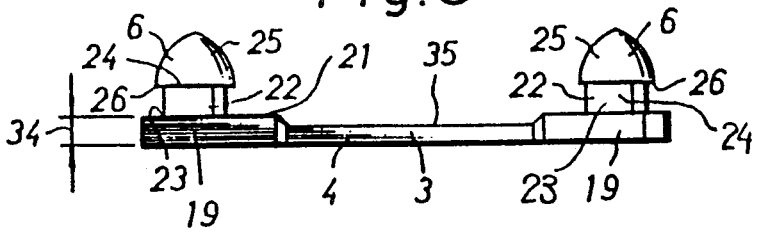
FIG. 3 is a front elevational view of the band member shown in FIG. 2.

The band member 4 is arranged as shown in FIGS. 2 and 3, and is formed of a flexible, resilient material so that at least a central portion 3 thereof located between both end portions 19 of the band member 4 is stretchable. As this flexible resilient member, a material which has good stretchability, such as synthetic rubber, natural rubber, or synthetic resin, is preferably selected. In term of its width 20, the band member 4 is formed to have a width which is substantially equal to or slightly greater than that of a shoelace which is generally used so far. In addition to adjusting the stretchability by selection of this flexible resilient material, the stretchability may be adjusted by setting the thickness of the central portion 3 of the band member 4 to be smaller than the thickness 34 of the both end portions 19. Furthermore, instead of adjusting the stretchability by changing the thickness of the central portion 3, the stretchability may be adjusted by making the width of the central portion 3 smaller than the width 20 of the both end portions 19.

Figure 4:
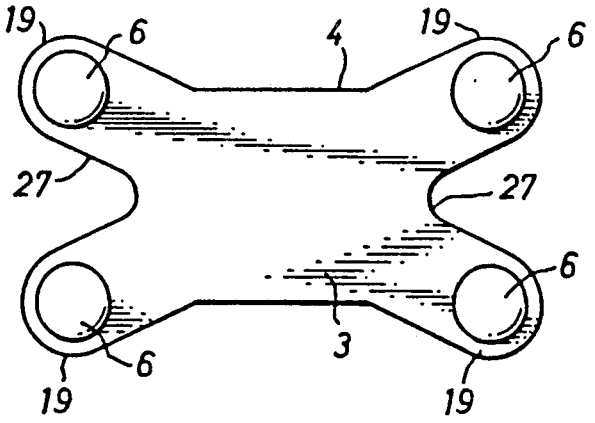
FIG. 4 is a top plan view of another example of the band member of the shoe fastening device in accordance with the present invention.
Figure 5:
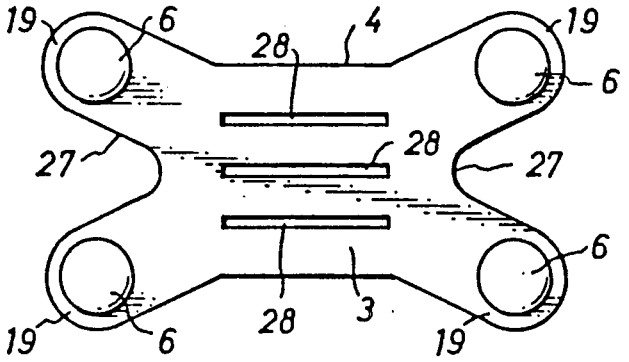
FIG. 5 is a top plan view of a modification of the band member shown in FIG. 4.
Figure 6:
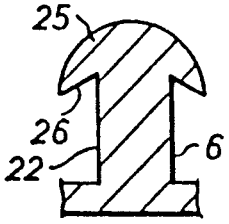
FIGS. 6 to 10 are views illustrating various modifications of a protruding member which is connected to the band member of the shoe fastening device in accordance with the present invention.
Figure 7:
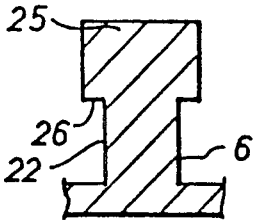
Figure 8:
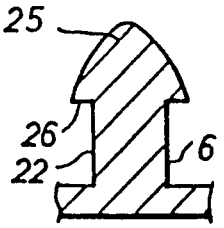
Figure 9:
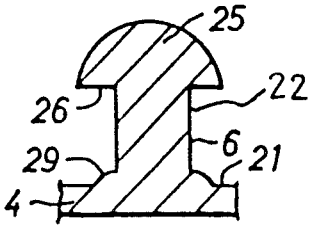
Figure 10:
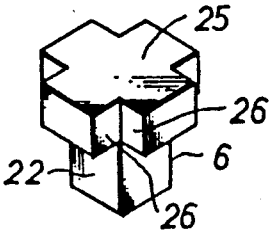

Each of both end portions 19 of the band member 4 is provided integrally with the protruding member 6 which projects upward, as viewed in FIG. 3. This protruding member 6 includes a leg 22 as a base portion, one end 23 of which is secured integrally to an upper surface 21 of the band member 4 shown in FIG. 3, and a conical mushroom-shaped portion 25 connected integrally to the other end 24 of the leg 22. The mushroom-shaped portion 25 as a head portion of the protruding member 6 has an overhanging portion 26 projecting from the leg 22 in the direction parallel with the upper surface 21 of the band member 4. Namely, the mushroom-shaped portion 25 is formed into a semispherical shape and is provided with the overhanging portion 26 which is formed with a greater diameter than that of the leg 22. A plate-shaped member 35 is constituted by the band member 4 and the protruding members 6. In addition, as for the band member 4, instead of using the band member 4 provided with a pair of protruding members 6, as shown in FIGS. 2 and 3, it is possible to use the band member 4 branched at both ends thereof as shown in FIG. 4, in which each of the protruding members 6 is disposed on the end portion 19 of each of the branches to be integrally connected to the end portion 19, the respective edge portions 27 defining the branches, respectively. It goes without saying that not only two but three or more protruding members 6 may be disposed on each of the both ends of the band member 4. In this case, in order to adjust the aforementioned stretchability of the band member 4, slits 28 may be formed in the central portion 3 of the band member 4, as shown in FIG. 5. The width and the configuration of the slit 28, or the number of such slits 28, may be selected as required. Furthermore, the mushroom-shaped portion 25 of the protruding member 6 may be formed as shown in FIGS. 6 to 10. Moreover, as for the leg 22 of the protruding member 6, as shown in FIG. 9, a corner portion 29 which is a connecting boundary portion between the leg 22 and the upper surface 21 of the band member 4 may be preferably formed with a larger thickness so as to increase the strength of the connection.

Figure 11:
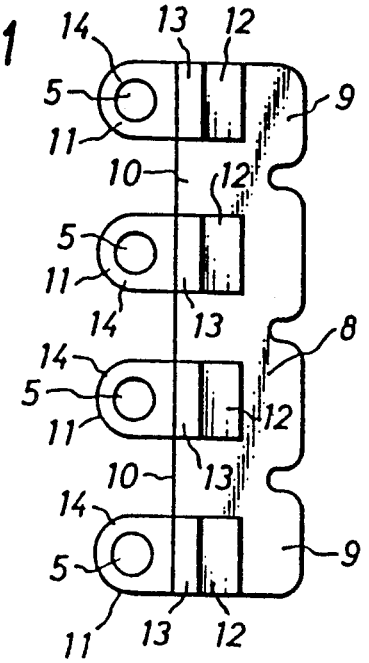
FIG. 11 is a top plan view of a support member for the shoe fastening device of the present invention and a protruding member connected to said supporting member.
Figure 12:
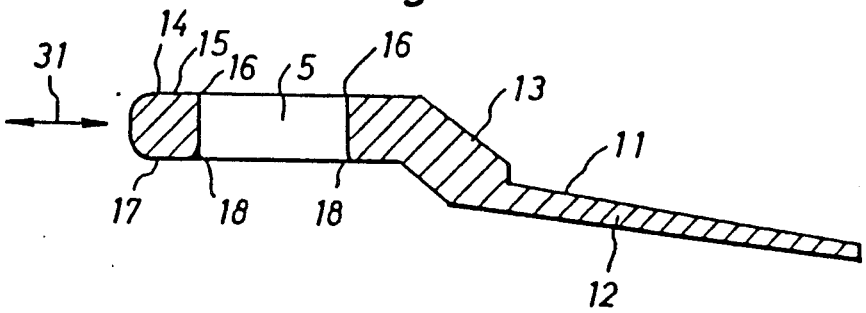
FIG. 12 is a cross-sectional view of the protruding member shown in FIG. 11.
Figure 13:
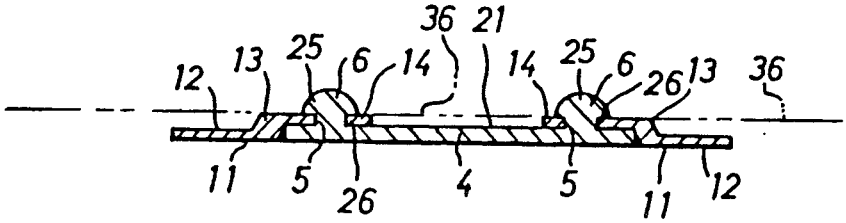
FIG. 13 is a cross-sectional view illustrating a state in which the band member and the protruding member which constitute connecting means of the shoe fastening device in accordance with the present invention are connected to each other.
Figure 14:
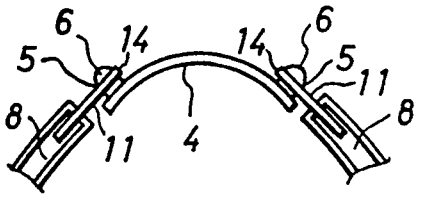
FIG. 14 is a view illustrating a state in which the band member and the protruding member in accordance with the conventional art are connected to each other.
Figure 15:
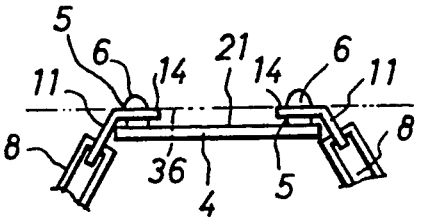
FIG. 15 is a view illustrating a state in which the band member and the protruding member of the shoe fastening device of the present invention are connected to each other.
Figure 16:
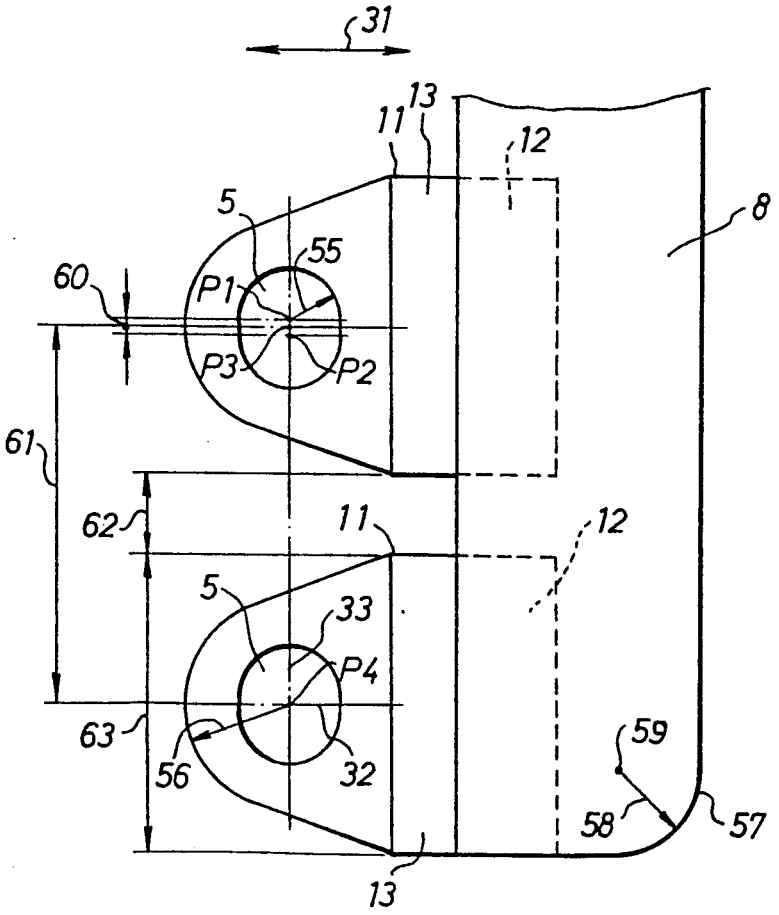
FIG. 16 is a top plan view of a support member for the shoe fastening device of the present invention and a protruding member connected to said supporting member.
Figure 17:
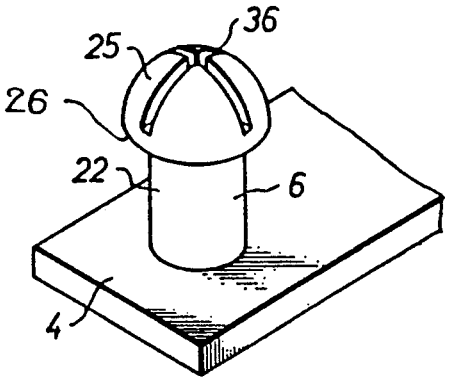
FIGS. 17 and 18 are views illustrating modifications of the protruding member connected to the band member of the shoe fastening device in accordance with the present invention.
Figure 18:
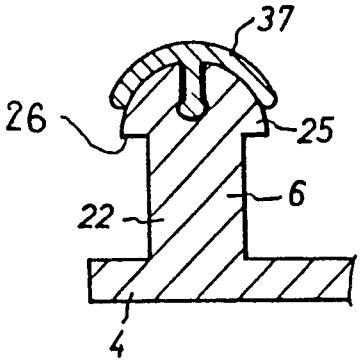

In addition, as shown in FIGS. 1 and 11, the upper cover 2 of the shoe 1 includes an opening portion 30, a support member 8 one edge portion 9 of which is connected to an opening edge portion 7 of this opening portion 30, and a plurality of projecting members 11 disposed along the other edge portion 10 of this support member 8. As for the material of the support member 8 and the projecting members 11, a material which is harder than the band member 8, such as a synthetic resin or a metal, preferably a nonferrous metal or the like, is selected. As shown in FIGS. 11 and 12, each of the projecting members 11 includes a proximal end member 12 connected to the edge portion 10 of the support member 8, an intermediate member 13 projecting from the proximal end member 12 in such a manner as to be bent upward, and a distal end member 14 extending horizontally from the intermediate member 13 in the direction of the arrows 31 shown in FIG. 12. It should be noted that although in this embodiment the support member 8 and the projecting member 11 are formed as separate bodies, they may, of course, be formed integrally. The proximal end member 12 of the projecting member 11 is formed integrally with the support member 8 is shown in FIG. 1, so that the proximal end member 12 is not particularly shown in FIG. 1. As shown in FIG. 13, the distal end member 14 is provided with the through hole 5 as a receiving portion, which is adapted to be capable of accommodating the protruding member 6 disposed integrally on the band member 4. It is necessary to set the degree of bending of the projecting member 11 in such a manner that the band member 4 will not be curved when the protruding member 6 of the band member 4 is inserted into the through hole 5 of the distal end member 14, as shown in FIG. 15. In other words, when the band member 4 is connected to the projecting member 11, as shown in FIGS. 13 and 15, it is necessary to position the distal end member 14 in such a manner that the distal end member 14 is projected upward by the thickness of the band member 4 or bent along the band member 4 so that the band member 4 and the distal end member 14 become parallel with each other. Namely, the through hole 5 should preferably be pierced such that a virtual plane 36 including the through holes 5 becomes parallel with the upper surface 21 of the band member 4. If the protruding member 6 of the band member 4 is inserted into the through hole 5 of the distal end member 14 of the projecting member 11 which is formed into a flat shape without being bent, as shown in FIG. 14, the band member 4 is curved largely. As a result, if the wearer of the shoe 1 engages in a severe exercise and a torsional force or the like is applied to the shoe 1, there is a possibility that the protruding member 6 becomes liable to come off easily from the through hole 5. In addition, as shown in FIG. 12, an opening end 18 of the through hole 5 at a lower surface 17 of the distal end member 14, shown in FIG. 12, is rounded to facilitate the insertion of the mushroom-shaped portion 15 of the protruding member 6. On the other hand, an opening end 16 of the through hole 5 at an upper surface 15 is formed into an angular shape so that the overhanging portion 26 of the mushroom-shaped portion 25 can be engaged with the opening end 16 securely in the state in which the protruding member 6 is accommodated in the through hole 5, as shown in FIG. 13. In addition, although in this embodiment the through hole 5 is formed into a circular shape, the configuration of the through hole 5 is not restricted to the same, and the through hole 5 may be formed into an oblong shape, as shown in FIG. 16, to facilitate the attachment and detachment of the protruding member 6. Incidentally, as an example of the size of the oblong shape, it is preferred that the radius 55 thereof from a center P1 is set to 2.5 mm, and that an interval 60 between the center P1 and a center P2 is set to 0.8 mm. Furthermore, it is preferred that, as shown in FIG. 16, an interval 61 between the centers P3, P4 of the adjacent through holes 5 is set to 18 mm, an interval 62 between the adjacent projecting members 11 is set to 4 mm, the width 63 of the projecting member 11 is set to 14 mm, a radius 56 of the distal end member 14 of the projecting member 11 from a center P4 of the projecting configuration is set to 5 mm, and a radius 58 of the support member 8 from a center 59 of a corner portion 57 of the support member 8 is set to 4 mm. It should be noted that, in accordance with the present invention, the dimensions are not to be restricted the aforementioned dimensions, and it goes without saying that various dimensions and dimensional proportions can be adopted. Furthermore, although in FIG. 16 a short axis 32 of the oblong shape is arranged in the direction of extension and contraction of the band member 4, i.e., in the direction shown by the arrow 31 in which the band member 4 is pulled along a longitudinal axis thereof (hereinafter referred to as the pulling direction). However, a long axis 33 of the oblong shape may be arranged in the pulling direction shown by the arrow 31. If the long axis 33 is arranged in the pulling direction shown by the arrow 31, it becomes difficult for the protruding member 6 to come off from the through hole 5. In addition, to facilitate the insertion and withdrawal of the protruding member 6 into the through hole 5, the mushroom-shaped portion 25 of the protruding member 6 may be provided with split grooves 36, as shown in FIG. 17. The number of these split grooves 36, the configuration thereof, the extending direction thereof, etc., can be optionally selected as required. Furthermore, to prevent the protruding member 6 from coming off from the through hole 5, it is possible to provide an arrangement in which, as shown in FIG. 18, the mushroom-shaped portion 25 is further provided with, for instance, a cap member 37, as a separate fixing member. In addition, the through hole 5 should preferably be formed in such a manner that the inside diameter of the through hole 5 is made slightly smaller than the outside diameter of the protruding member 6 to allow the protruding member 6 of the band member 4 to engage firmly with the through hole 5, i.e., in such a manner that the overhanging portion 26 of the mushroom-shaped portion 25, which is the largest diameter portion of the protruding member 6, can barely pass through the through hole 5 and the leg 22 is then accommodated in the through hole 5.

Figure 19:
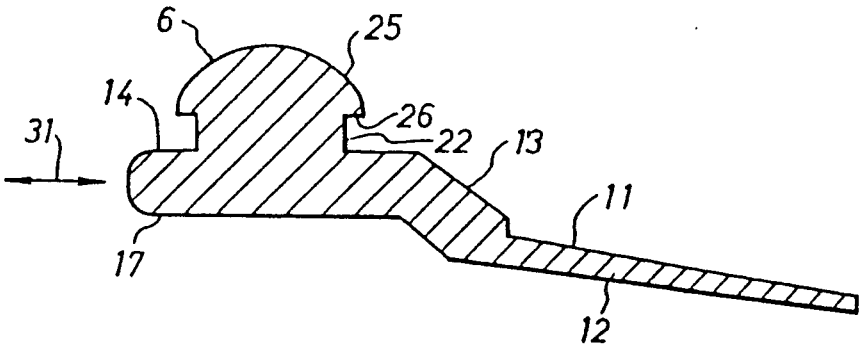
FIG. 19 is a cross-sectional view illustrating another modification of the protruding member.
Figure 20:
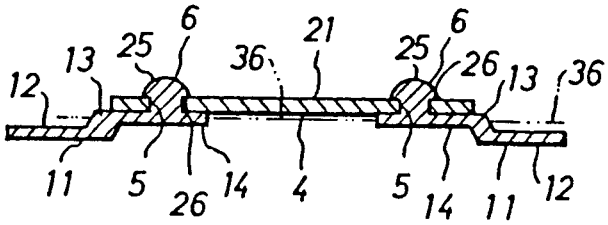
FIG. 20 is a cross-sectional view illustrating a state in which there are connected to each other the band member and the protruding member which constitute a modification of the connecting means of the shoe fastening device in accordance with the present invention.

In this embodiment, the connecting means is constituted by the protruding member 6 disposed integrally on the band member 4 as well as the through hole 5 disposed on the upper cover 2. However, it goes without saying that, as shown in FIGS. 19 and 20, the connecting means may be constituted by the through hole 5 disposed on the band member 4 and the protruding member 6 disposed integrally on the distal end member 14 of the projecting member 11 constituting the upper cover 2. In this case, the protruding member 6 may be formed of a metallic material to facilitate the insertion thereof into the through hole 5.

Accordingly, in accordance with this embodiment, the wearer of the shoe 1 is capable of attaching sequentially the band members 4 to the upper cover 2 of the shoe 1 while selecting the band members 4 of desired lengths relative to the respective positions at which the band members 4 are to be disposed from the toe side of the opening portion 30 toward the top-line so as to adjust the fastening force for the shoe 1. Since the band member 4 is formed of a stretchable, flexible and resilient material, the band member 4 is capable of softly pressing the upper cover 2 while the wearer wears the shoe 1, thereby imparting an agreeable sense of fitting to the wearer of the shoe 1. Furthermore, due to the stretchability of the band member 4, the opening portion 30 can open wide, which extremely facilitates the insertion of the foot at the time of wearing the shoe 1.

Since the independent band members 4 are adopted in the shoe fastening device in accordance with this embodiment, it is possible to obtain a colorful and novel design by appropriately selecting and combining various colors of the band members 4.

With the shoe fastening device in accordance with this embodiment, when the band members 4 are not used, it is possible to obtain the fastening function for the shoe 1 by inserting a conventional shoelace through the through holes 5.

Next, a description will be given of another embodiment of the shoe fastening device in accordance with the present invention with reference to FIG. 21.

Those portions that are identical with those of the above-described embodiment are denoted by the same reference numerals, and a description thereof will be omitted.

Figure 21:
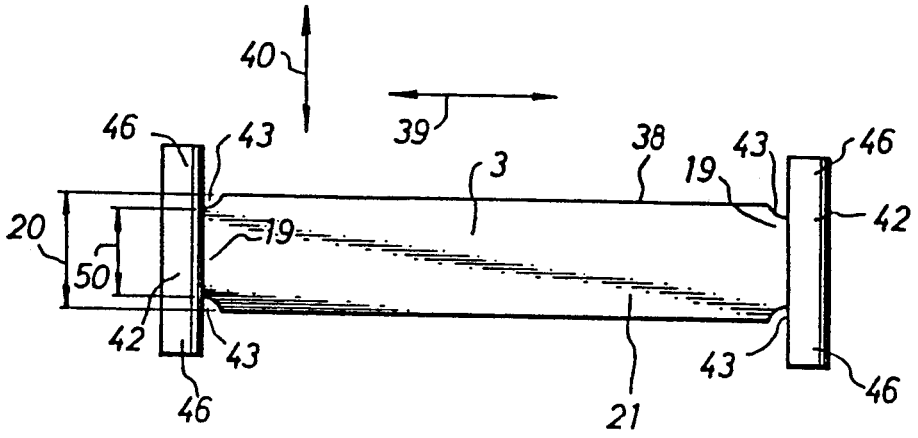
FIG. 21 is a top plan view of a band member in another embodiment of the shoe fastening device of the present invention.
Figure 22:
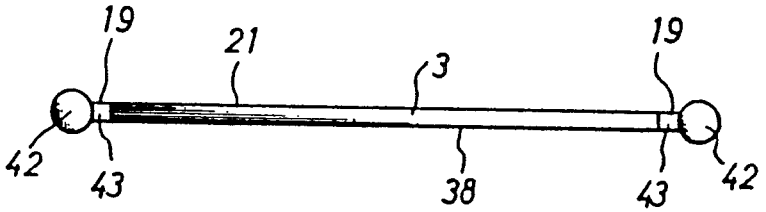
FIG. 22 is a front elevational view of the band member shown in FIG. 19.

In the shoe fastening device of this embodiment, instead of the band member 4 having the above-described configuration, a band member 38 shown in FIGS. 21 and 22 is adopted. Bar-shaped protruding members 42, which are arranged in the direction of the arrows 40 intersecting the longitudinal direction of the band member 38 shown by the arrows 39, are integrally connected to both end portions of the band member 38. This protruding member 42 is formed and secured to the band member 38 in such a manner as to be longer than the width 20 of the band member 38 so as to be provided with projecting portions 46 each projecting from the band member 38. A recess 43 is disposed on each side of a connecting boundary portion between the band member 38 and the protruding member 42 so as to strengthen engagement between the protruding member 42 and an opening 45 which is formed by a pair of projecting members 44, and serves as a receiving portion. The pair of projecting member 44 will be described later.

As for the band member 38, the material of the central portion 3, the presence of slits, the configuration of the central portion 3 including the width and thickness, and the like can be selected as required in the same way as the band member 4 having the configuration set forth with the above-described embodiment. With respect to the material of the projecting member 44 as well, a synthetic resin, a metal, or the like can be selected in a similar manner.

Figure 23:
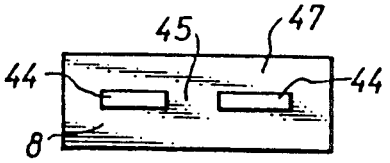
FIGS. 23 and 24 are views illustrating a support member and a protruding member connected thereto in said another embodiment of the shoe fastening device of the present invention.
Figure 24:
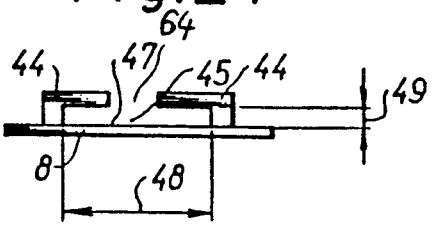
Figure 27:
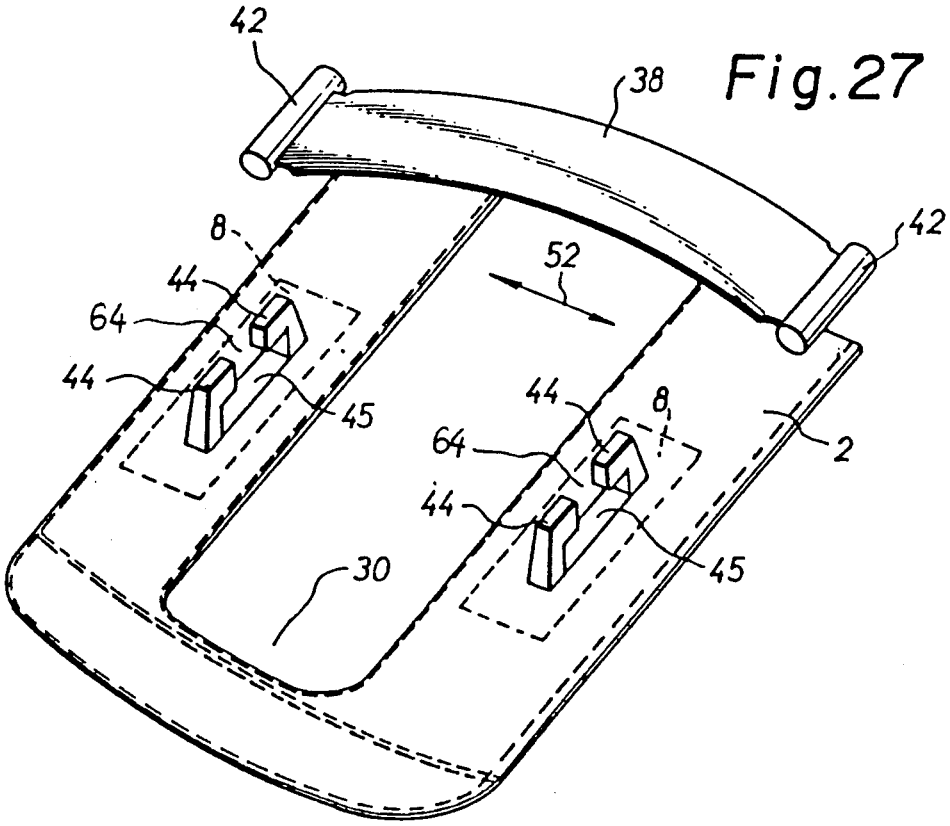
FIG. 27 is a view illustrating a state in which the band member shown in FIGS. 21 and 22 is connected to the support member and the protruding member which are shown in FIGS. 23 and 24 in accordance with said another embodiment of the shoe fastening device of the present invention.

FIGS. 23 and 24 show the support member 8 formed in the same way as that of the above-described embodiment, as well as a pair of the U-shaped projecting members 44 that are connected integrally to an upper surface 47 of the support member 8 shown in FIG. 24. The pair of U-shaped projecting members 44 are arranged to face each other so as to form the opening 45 for accommodating the band member 38 at the time when the band member 38 is connected to the upper cover 2. The width 48 of the opening 45 is preferably selected in such a manner as to be substantially equal with the width of the band member 38 at the connecting boundary portion between the band member 38 and the protruding member 42, i.e., substantially equal with the width 50 defined by the recesses 43 (see FIG. 21). In addition, the thickness 49 of the opening 45 is preferably selected in such a manner as to be substantially equal with the thickness of the band member 38. If the band member 38 is fitted in the thus formed opening 45 through a narrow top opening portion 64 of the opening 45, as shown in FIG. 27, even if a tensile is force is applied to the band member 38, the projecting portions 46 of the protruding member 42 abut against and are engaged with the pair of U-shaped projecting members 44, so that the connection between the band member 38 and the upper cover 2 can be maintained in this state. In other word, the connecting means is constituted by the protruding members 42 and the pair of U-shaped projecting members 44 forming the opening 45.

Figure 25:
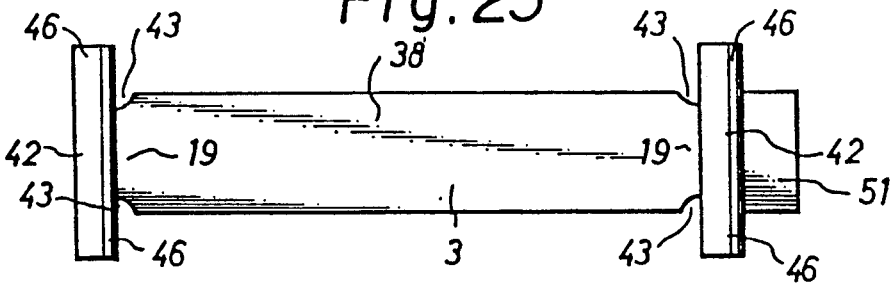
FIG. 25 is a top plan view of a modification of a band member in said another embodiment of the shoe fastening device of the present invention.
Figure 26:
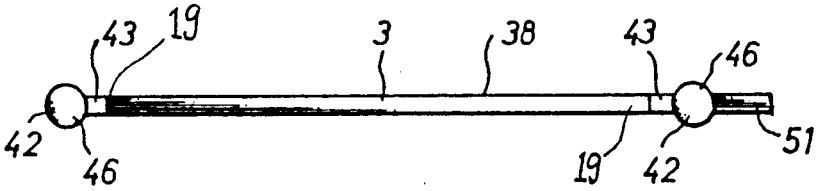
FIG. 26 is a front elevational view of the band member shown in FIG. 25.

In addition to the band member 38 shown in FIGS. 21 and 22, it is preferable to further connect a grip member 51 to one end portion 19 of the band member 38 so as to facilitate the attachment and detachment of the band member 38 with respect to the upper cover 2 as shown in FIGS. 25 and 26. Furthermore, it goes without saying that this grip member 51 may be connected to both end portions 19 of the band member 38.

Also, it goes without saying that arrangements in accordance with various modifications can be adopted for the band member 38 of this embodiment in the same way as the band member 4 in accordance with the above-described embodiment.

The shoe fastening device in accordance with this embodiment is arranged such that, as shown in FIG. 27, the band member 38 can be fitted from above the narrow top opening portion 64 of the opening 45 formed by the pair of U-shaped projecting members 44. Accordingly, the wearer of the shoe 1 can more easily fit the band member 38 onto the upper cover 2. Additionally, when a force is applied to the opening portion 30 of the upper cover 2 in the directions of the arrows 52, i.e., in the directions in which the opening portion 30 is opened, the protruding members 42 are capable of receiving the force at the longitudinally two portions, so that the protruding member 42 can withstand increased tensile strength, thereby making it possible to further increase the durability of the shoe fastening device.

If a large force which exceeds the strength of the shoe fastening device is applied to the upper cover 2, in both embodiments described above, it is preferable to select a material for the band member that enables the band member to be destroyed in such a case, or to provide an arrangement that the band member is destroyed in such a case.

As described above, since band members independent of one another are employed in the shoe fastening device in accordance with the present invention, it is possible to select, as necessary, band members of predetermined fastening force, and an optimum fastening condition can simply be obtained for the wearer of the shoes with quickness.

What is claimed is:

1. A shoe fastening device comprising:

a plurality of first projecting members spaced apart from one another on one part of an opening edge portion defining an opening portion of an upper cover of said shoe along a longitudinal direction of said shoe, each of said first projecting members projecting at a distal end thereof into said opening portion;

a plurality of second projecting members spaced apart from one another on the other part of said opening edge portion along said longitudinal direction, each of said second projecting members projecting at a distal end thereof into said opening portion and facing each of said first projecting members respectively, said other part being opposite to said one part; and a plurality of band members each disposed between one of said first projecting members and one of said second projecting members corresponding to said one of said first projecting members;

each of said first projecting members comprising a first proximal end portion fixed to said one part, a first intermediate portion connected at one end thereof to one end of said first proximal end portion and projecting upwardly from an outer surface of said first proximal end portion, a first distal end portion connected at one end thereof to the other end of said first intermediate portion and extending horizontally from said other end of said first intermediate portion to said opening portion, and a first through hole disposed in said first distal end potion of each of said first projecting members;

each of said second projecting members comprising a second proximal end portion fixed to said other part, a second intermediate portion connected at one end thereof to one end of said second proximal end portion and projecting upwardly from an outer surface of said second proximal end portion, a second distal end portion connected at one end thereof to the other end of said second intermediate portion and extending horizontally from said other end of said second intermediate portion to said opening portion, and a second through hole disposed in said second distal end portion of each of said second projecting members;

each of said band members being formed of a stretchable and flexible material at at least a central portion thereof with respect to a longitudinal direction thereof and having end portions on either side of said central portion, each of said band members comprising a first protruding member disposed integrally to one of said end portions of each of said band members and adapted to be inserted into said first through hole from an inner surface of said first distal end portion toward an outer surface of said first distal end portion, and a second protruding member disposed integrally to the other of said end portions of each of said band members and adapted to be inserted into said second through hole from an inner surface of said second distal end portion toward an outer surface of said second distal end portion;

a thickness of each of said band members and an amount of projection of each of said first intermediate portions and each of said second intermediate portions being set so that said first distal end portions, said second distal end portions and said band members become respectively coplanar at inner surfaces thereof, whereby said upper cover is fastened to wearer's foot through said band members.

2. A shoe fastening device according to claim 1, in which a thickness of said central portion of each of said band members is smaller than that of each of said end portions.

3. A shoe fastening device according to claim 1, in which the width of said central portion of each of said band members is smaller than that of each of said end portions.

4. A shoe fastening device according to claim 1, in which two adjacent band members are connected to each other at central parts thereof.

5. A shoe fastening device according to claim 1, in which said central portion of each of said band members has a slit which allows the stretchability of said central portion to be adjusted.

6. A shoe fastening device according to claim 5, in which both of said first and second through holes are oblong.

7. A shoe fastening device according to claim 6, in which the long axis of said oblong hole is arranged along a longitudinal direction of said band member.

8. A shoe fastening device according to claim 1, in which each of said first protruding members and each of said second protruding members are fixed integrally to one surface of each of said band members, each of said first protruding members and each of said second protruding members have a distal end part, said distal end part having a portion projecting in a direction parallel to said one surface on a side of said distal end part.

9. A shoe fastening device according to claim 8, in which said distal end part is semi-spherically shaped and is attached to each of said band members by a leg portion, and said projecting portion is larger in diameter than said leg portion.

10. A shoe fastening device according to claim 9, in which said distal end part has a slit groove on a top surface thereof, said slit groove being adapted to receive a fixing member which secures each of said first protruding members and each of said second protruding members to each of said first through holes and each of said second through holes, respectively.

11. A shoe fastening device according to claim 10, in which a portion connecting said leg portion to said one surface of each of said band members is greater in diameter than said leg portion to reinforce the connection of said leg portion to each of said band members.

* * * * *